US006729103B1

(12) United States Patent
Hartness et al.

(10) Patent No.: US 6,729,103 B1
(45) Date of Patent: May 4, 2004

(54) CONTINUOUS CIRCULAR MOTION CASE PACKING AND DEPACKING APPARATUS AND METHOD

(75) Inventors: Thomas Patterson Hartness, Greenville, SC (US); David N. Cooley, Greenville, SC (US); Richard M. Wiernicki, Roebuck, SC (US); Robert Leslie Dillard, Easley, SC (US); David Lee Scott, Greenville, SC (US)

(73) Assignee: Hartness International, Inc., Greenville, SC (US)

( * ) Notice: Subject to any disclaimer, the term of this patent is extended or adjusted under 35 U.S.C. 154(b) by 0 days.

(21) Appl. No.: 09/418,619

(22) Filed: Oct. 15, 1999

Related U.S. Application Data

(63) Continuation-in-part of application No. 09/301,394, filed on Apr. 28, 1999, now Pat. No. 6,571,532, which is a continuation-in-part of application No. 09/137,327, filed on Aug. 20, 1998, now abandoned, which is a continuation-in-part of application No. 08/736,376, filed on Oct. 26, 1996, now Pat. No. 5,797,249, which is a continuation-in-part of application No. 08/338,026, filed on Nov. 10, 1994, now Pat. No. 5,588,282.

(51) Int. Cl.[7] ..... B65B 5/08
(52) U.S. Cl. ..... 53/247; 53/251; 53/539
(58) Field of Search ..... 53/473, 248, 251, 53/497, 539, 475, 250, 249, 247, 445, 446, 234, 48.5, 253

(56) References Cited

U.S. PATENT DOCUMENTS

| | | | | |
|---|---|---|---|---|
| 1,481,259 | A | 1/1924 | Harrison | |
| 1,538,406 | A | 5/1925 | McCarty et al. | |
| 1,583,767 | A | 5/1926 | Akins et al. | |
| 1,958,846 | A | 5/1934 | Christensen | |
| 2,277,688 | A | 3/1942 | Cattonar et al. | 53/248 |
| 2,350,692 | A | 6/1944 | Milek | 294/116 |
| 2,730,279 | A | 1/1956 | Enock | 226/14 |
| 2,760,316 | A | 8/1956 | Okulitch et al. | 53/61 |
| 2,807,125 | A | 9/1957 | George | 53/166 |
| 2,860,763 | A | 11/1958 | Kohrs et al. | 198/33 |

(List continued on next page.)

FOREIGN PATENT DOCUMENTS

| | | | |
|---|---|---|---|
| DE | 11 52 351 B | 8/1963 | |
| DE | 27 11 702 A | 9/1978 | B65B/35/44 |
| DE | 28 15 123 A | 7/1979 | B65B/21/18 |
| DE | 34 31 066 A | 3/1986 | B65B/21/18 |
| DE | 4216721 A1 * | 11/1993 | |
| GB | 2 090 804 A | 7/1982 | |

*Primary Examiner*—John Sipos
*Assistant Examiner*—Louis Huynh
(74) *Attorney, Agent, or Firm*—McNair Law Firm, P.A.; Cort Flint

(57) ABSTRACT

An apparatus and method for continuously transferring articles from a pickup station to a release station using a circular, continuously rotating turret is disclosed which includes a plurality of transfer arms carried in a circular motion wherein pickup heads carried by the transfer arms are converted from the circular motion to a straight-line motion during pick up of the articles to provide a case packing machine having high speed and reliable operation. In accordance with the general aspects of the invention, a first conveyor is disclosed for conveying the articles to a pickup station and a second conveyor is provided for delivering the articles away from a release station. One of the first and second conveyors includes an arcuate conveyor section disposed below a congruent path of the pickup heads. At least one of the pickup and release stations is advantageously located over the arcuate conveyor section whereby high speed operation requiring only a small amount of machine floor space is provided. When utilized as a case packing machine, both the pickup heads and grid heads, which define a plurality of guides through which the articles are released at the case packing station, are moved in a translatory motion during article pick up.

11 Claims, 17 Drawing Sheets

U.S. PATENT DOCUMENTS

| | | | | | |
|---|---|---|---|---|---|
| 3,012,811 | A | | 12/1961 | Sandrock | 294/83 |
| 3,327,450 | A | | 6/1967 | Carter | 53/61 |
| 3,410,050 | A | | 11/1968 | Bell | 53/165 |
| 3,505,787 | A | | 4/1970 | Tiews | 53/166 |
| 3,553,927 | A | | 1/1971 | Anglade, Jr. | 53/26 |
| 3,553,932 | A | | 1/1971 | Rowekamp | 53/539 |
| 3,555,770 | A | | 1/1971 | Rowekamp | 53/61 |
| 3,555,773 | A | | 1/1971 | Rowekamp | 53/166 |
| 3,648,427 | A | | 3/1972 | Raudat et al. | 53/61 |
| 3,727,366 | A | | 4/1973 | Schlueter et al. | 53/61 |
| 3,780,492 | A | | 12/1973 | Corderoy | 53/247 |
| 3,805,476 | A | | 4/1974 | Kawamura et al. | 53/26 |
| 3,971,190 | A | | 7/1976 | McGill | 53/77 |
| 4,055,943 | A | | 11/1977 | Reichert | 53/247 |
| 4,215,521 | A | | 8/1980 | Hartness | 53/248 |
| 4,245,452 | A | * | 1/1981 | Fujio | |
| 4,294,057 | A | * | 10/1981 | Winiasz et al. | |
| 4,300,330 | A | | 11/1981 | Hartness | 53/539 |
| 4,446,672 | A | | 5/1984 | Raudat | 53/448 |
| 4,457,121 | A | * | 7/1984 | Johnson et al. | |
| 4,541,524 | A | | 9/1985 | McGill et al. | 198/470 |
| 4,587,792 | A | | 5/1986 | Hartness et al. | 53/382 |
| 4,723,649 | A | | 2/1988 | Hartness et al. | 198/442 |
| 4,866,912 | A | * | 9/1989 | Deutsch | |
| 4,891,928 | A | * | 1/1990 | James et al. | |
| 4,998,399 | A | | 3/1991 | Lutzke | |
| 5,212,930 | A | | 5/1993 | Raudat | 53/539 |
| 5,257,888 | A | | 11/1993 | Kronseder | 414/416 |
| 5,301,489 | A | * | 4/1994 | Benedetti | |
| 5,313,764 | A | | 5/1994 | Kronseder | 53/247 |
| 5,375,395 | A | | 12/1994 | Gmeiner | 53/473 |
| 5,456,563 | A | * | 10/1995 | Halbo | |
| 5,487,257 | A | | 1/1996 | Domeier et al. | 53/539 |
| 5,501,064 | A | | 3/1996 | Ingram et al. | 53/473 |
| 5,555,709 | A | | 9/1996 | Savigny et al. | 53/570 |
| 5,588,282 | A | | 12/1996 | Hartness | 53/538 |
| 5,713,180 | A | * | 2/1998 | Lewis | |
| 5,797,249 | A | | 8/1998 | Hartness | 53/473 |

* cited by examiner

CONTINUOUS CIRCULAR MOTION CASE PACKING AND DEPACKING APPARATUS AND METHOD

This is a continuation-in-part of a copending application Ser. No. 09/301,394, filed Apr. 28, 1999, now U.S. Pat. No. 6,571,532 entitled Continuous Motion Case Packing Apparatus And Method; which is a continuation-in-part of application Ser. No. 09/137,327, filed Aug. 20, 1998, entitled Continuous Motion Case Packing Apparatus, now abandoned; which is a continuation of application Ser. No. 08/736,376, filed on Oct. 26, 1996, entitled Continuous Motion Case Packing Apparatus, which is now U.S. Pat. No. 5,797,249 issued on Aug. 25, 1998; which is a continuation-in-part of application Ser. No. 08/338,026, filed on Nov. 10, 1994, entitled Continuous Motion Case Packing Apparatus, which is now U.S. Pat. No. 5,588,282 issued on Dec. 31, 1996; and the above applications and patent disclosures are incorporated herein by reference.

BACKGROUND OF THE INVENTION

The invention relates to an apparatus and method for transferring articles into and out of cases using continuous motion, and particularly, where the continuous motion is basically circular at higher transfer speeds with a small footprint.

In the art of case packing, large numbers of articles must be grouped and packaged rapidly by an apparatus that will function dependably without damage to the articles processed. When unpacking articles from cases, the articles are already grouped in a pattern in the case reducing some of the problems of article pickup. Case packing apparatus has been generally categorized as either intermittent case packing or continuous case packing. In intermittent case packing the article flow and/or case flow is interrupted during article pickup and/or release. Most recently, attention has been directed to continuous case packing in order to increase production. However, the continuous case packing has brought increased problems with handling the processed articles without breakage, damage, or interruption.

In the continuous case packing apparatus, articles are grouped together in successive slugs at a pickup position. The slugs are typically picked up at the pickup position by article grippers carried by an orbital handling machine rotating about two vertical axes. The slugs are transferred to a case loading position where the grippers release the slug of articles into a case. The articles can be released either simultaneously or sequentially as the case is conveyed beneath the slug of articles. Apparatus of this type may be either of the "drop packer" type or "placement packer type." In the drop packer type, the articles are allowed to drop at least a small distance into the case after release. In the placement packer type, the drop, if any, is minimal and the articles are essentially placed gently onto the bottom of the case.

Continuous motion machines rotating about a single horizontal axis are shown in U.S. Pat. Nos. 5,375,395, 5,257,888, and 5,313,764 using articulating arms and pickup heads. A set of article grippers is carried on the ends of the articulating arms. However, during the angular descent from the pickup position to the case packing position, both horizontal and vertical accelerations are typically encountered by the articles which are gripped only at their tops or necks. Intermittent circular machines rotating about a single vertical axis are shown in U.S. Pat. Nos. 3,780,492 and 2,807,125.

Various other case packers, generally of the continuous motion type, using a vertical orbital conveyor are shown in U.S. Pat. Nos. 5,212,930; 4,541,524; and 4,294,057. The first patent shows depositing the articles sequentially and individually, rather than as a group or slug, into partitioned cases without positively gripping the articles. The latter two patents use gripper devices to grip and place the articles. U.S. Pat. No. 4,457,121 discloses a continuous motion bottle packer wherein a plurality of grids are mounted individually on spokes of a vertical wheel so that each grid moves through an article infeed position where groups of articles are fed into the grid without interrupting the forward speed. Angular and horizontal accelerations of the articles and their contents are encountered due to the rotary wheel motion during the transfer which may be detrimental to the article and/or contents.

Continuous case packers are also known in which a horizontal rotary carousel is used to move vertically reciprocating gripper sets in a horizontal plane about two vertical axes. The reciprocating gripper sets pick up a slug of articles at one position and transfer the slug of articles to a second position where the gripper set is lowered to deposit the articles into a case. Typically the pickup and release stations are on opposite sides of the carousel, requiring parallel conveyors on each side. However, the disposition of the rotary carousel in a horizontal plane requires an inconvenient floor lay-out which also occupies a large amount of floor space. The parallel conveyor arrangements needed for the infeed and outfeed of articles adds to the floor space problem. The path of the gripper sets between the slug pickup position and the case packing position is also typically curved producing angular and acceleration forces on the articles. The curved article transfer path intersects the path of the conveyed case only for a brief interval making timing a factor. In various of the rotary carousel types, it is known to deposit the articles by lowering the articles, already gripped by the gripper set, through resilient fingers that guide the articles into partitioned cases.

Case packers, generally of the intermittent type, are shown in U.S. Pat. Nos. 3,553,932 and 3,505,787 which also disclose using combinations of a lifting head having suction cups and bottle grids having pockets for picking up containers and depositing them into cases. The containers and the cases are conveyed on parallel conveyors rather than in-line conveyors, and the transfer from the pickup position to the case loading position is lateral, or transverse, to the flow of containers and cases. U.S. Pat. No. 2,277,688 discloses another case packer using an arrangement of a gripper set and a bottle guide set to package the containers into a case. These type of case packers are generally non-continuous as compared to the continuous motion in-line transfer case packers described above where neither the flow of articles nor the flow of the cases is interrupted during operation of the packer.

Accordingly, an object of the invention is to provide an improved continuous case packing and depacking apparatus having a characteristic circular motion.

Another object of the invention is to provide a continuous motion apparatus and method which moves in a circular motion to provide high speeds of operation.

Another object of the invention is to provide a continuous, circular motion case packing or depacking apparatus and method which rotates about a single axis to provide a small footprint and high speed operation.

Another object of the invention is to provide a continuous, circular motion case packing apparatus and method in which slugs or groups of articles are picked up and transferred to a release station where the motion of the pickup heads is converted to a substantially straight-line motion along a pickup section during which time the articles are picked up.

Still another object of the invention is to provide a continuous, circular motion case packing or depacking apparatus and method wherein the articles are either picked up or released over an arcuate section of a conveyor disposed below the path of pickup heads rotating along a common arc.

Yet another object of the invention is to provide a continuous motion apparatus and method in which a revolving turret moves a plurality of transfer arms in a circular path about a single vertical axis as reciprocating article pickup heads and/or grid heads, carried by the transfer arms, pickup and release the articles wherein either the pick up or release occurs over an arcuate conveyor section disposed below the pickup heads moving in a circular motion for high speed, reliable operation.

SUMMARY OF THE INVENTION

The above objectives are accomplished according to the present invention by providing apparatus and method for transferring articles from a pickup station to a release station basically in a continuous circular motion. The apparatus includes a rotating turret which continuously rotates about a substantially vertical axis for continuously transferring the articles. A plurality of reciprocating article pickup heads are carried by the rotating turret for continuously and successively picking up groups of the articles at the pickup station and releasing the articles at the release station. A conveyor is provided having an arcuate conveyor section disposed generally below a congruent path of the pickup heads over which the heads are continuously rotated. Advantageously, one of the pickup and release stations is located along the arcuate section of the conveyor.

In a case packing embodiment of the invention, the turret rotates the pickup heads in a closed curvilinear path around the vertical axis which includes a circular section and a generally linear pickup section along which the circular motion of the pickup heads is converted to a substantially linear motion to pick up the articles while the turret rotates. For this purpose, the apparatus may include a motion converter operatively associated with the pickup heads for causing the pickup heads to move generally in a straight-line motion along the pickup section, a distance which corresponds generally to a predetermined arc of turret rotation. In one illustrated embodiment of the invention, the motion converter includes support frames carried by transfer arms, and the pickup heads are slidably carried by the support frames whereby the pickup heads swivel and translate to maintain a straight-line motion along the pickup section as the turret rotates. The motion converter may include connector mechanisms associated with the rotating turret and the pickup heads for imparting the motion. Advantageously, the connector mechanisms may include vertical cam shafts and linkage arrangements connected between the cam shafts and pickup heads. The linkage arrangements are slidably carried by the vertical cam shafts to slide up and down as the pickup heads reciprocate during pick up and release of the articles. Cam followers may be connected to the linkage arrangements, with at least one cam assembled to a fixed center column which the cam followers follow as the turret rotates to impart the straight-line motion to the pickup heads.

The pickup station may be a station where articles are picked up for packing into cases, or a station where empty articles are removed from cases. Likewise, the release station may be a case packing station, or a station where empty articles are released on a conveyor to be conveyed away. When the release station is a case packing station, it may be located along the arcuate conveyor section, and the conveyor conveys indexed cases to the arcuate conveyor section for receiving the released articles in synchronization with the rotating turret. In this case, a plurality of grid heads may be advantageously carried below the pickup heads. The grid heads may have guides in the form of pivoting grid fingers arranged in a grid corresponding to an array of the articles to be picked up. The grid fingers define grid chutes having upper and lower ends for receiving the articles. The pickup heads have gripper elements arranged in a pattern corresponding to the pattern of grid chutes for gripping the articles.

Preferably, a vertical motion mechanism is provided which controls the operative positions of the pickup and/or grid heads. The mechanism may include two cams encircling and supported by the stationary center column affixed inside the rotating turret. The pickup and grid heads may be slidably carried on vertical transfer arms carried by the turret. A cam roller associated with the pickup and grid heads rides on a respective cam to control the vertical position of the heads. A pickup head actuator mechanism may be provided for actuating the gripper elements to selectively grip and release the articles. In one form of the invention, the pickup head actuator mechanism may include gripper actuators carried by the pickup heads having movement between a closed position wherein the articles are gripped, and an open position wherein the articles are released by the gripper elements. An operator controls the movement of the gripper actuators between the open and closed position. An engagement member may be carried by the stationary column and positioned at the release station. The operator is arranged to strike the engagement member at the release station whereby the gripper actuators are moved to the open position for releasing the articles. In the case packing embodiment of the invention, the grid heads provide guides so that the articles are reliably inserted into pockets of the partitioned cases. For this reason, the motion of the grid heads may also be controlled by the motion converter in unison with the pickup heads whereby their circular motion is converted into a straight-line motion for article pick up.

In accordance with the method of the invention, a method is provided for continuously transferring articles between a pickup station and a release station which comprises continuously conveying the articles to a pickup station; and continuously picking the articles up at the pickup station using pickup heads rotating about a single vertical axis in a closed cyclic path. Basically, as applied to case packing, the invention contemplates using reciprocating pickup heads carried on a rotating turret, and converting the circular motion of the pickup heads to a straight-line motion over a predetermined arc of the turret along which the articles are picked up. The method advantageously includes providing an arcuate conveyor section, and carrying out one of the article pick up and release steps while the pickup heads are moving in a common path over the arcuate conveyor section. The method includes, in one embodiment, conveying the cases to the arcuate conveyor section and picking up empty articles from the cases along the arcuate conveyor section for depacking the cases. In a second embodiment, the invention includes picking up articles delivered by an article infeed conveyor, and releasing the articles over the arcuate conveyor section into empty cases at a case packing station.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
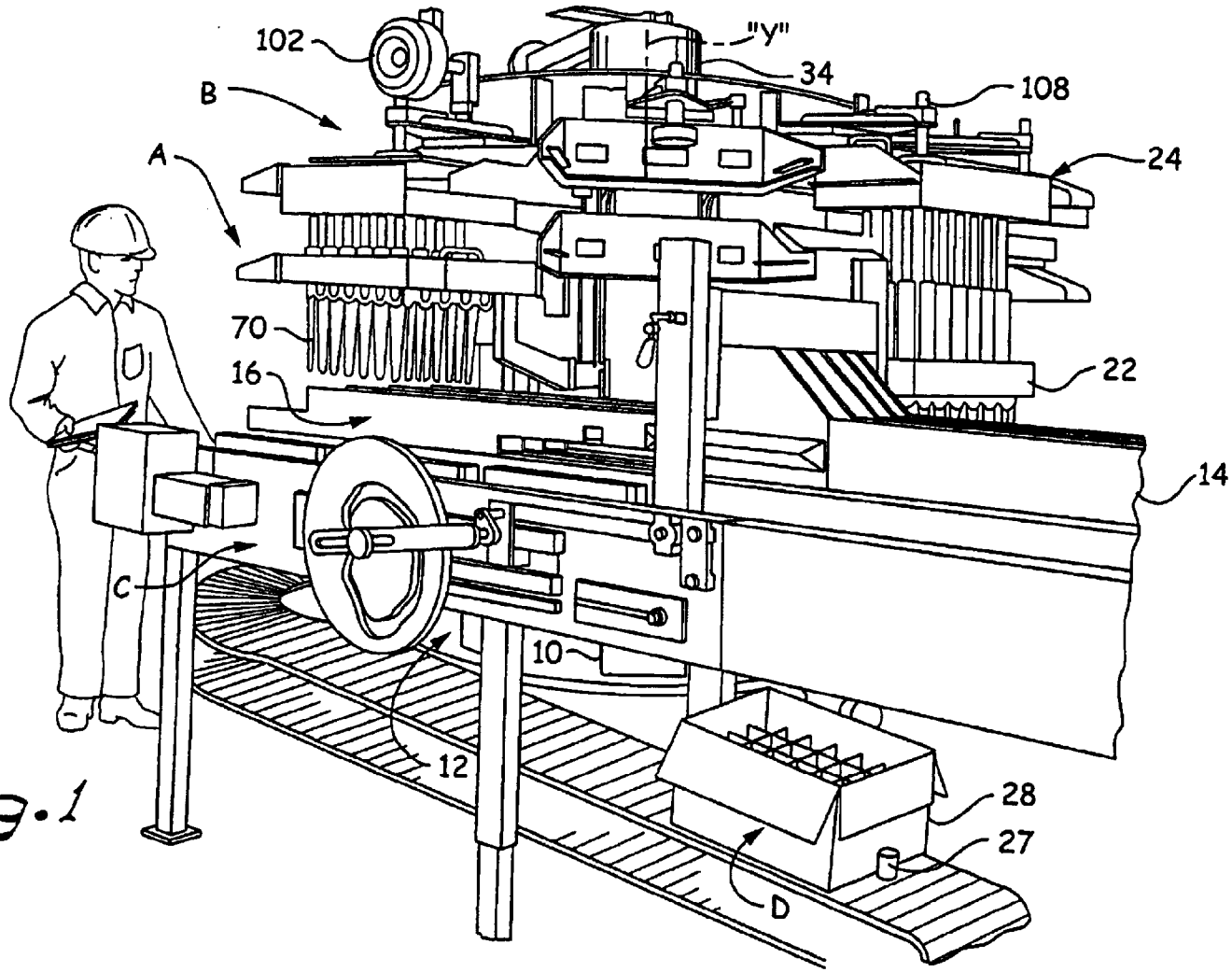
FIG. 1 is a perspective view of a circular, continuous motion case packing and depacking apparatus and method according to the invention.
Figure 2:
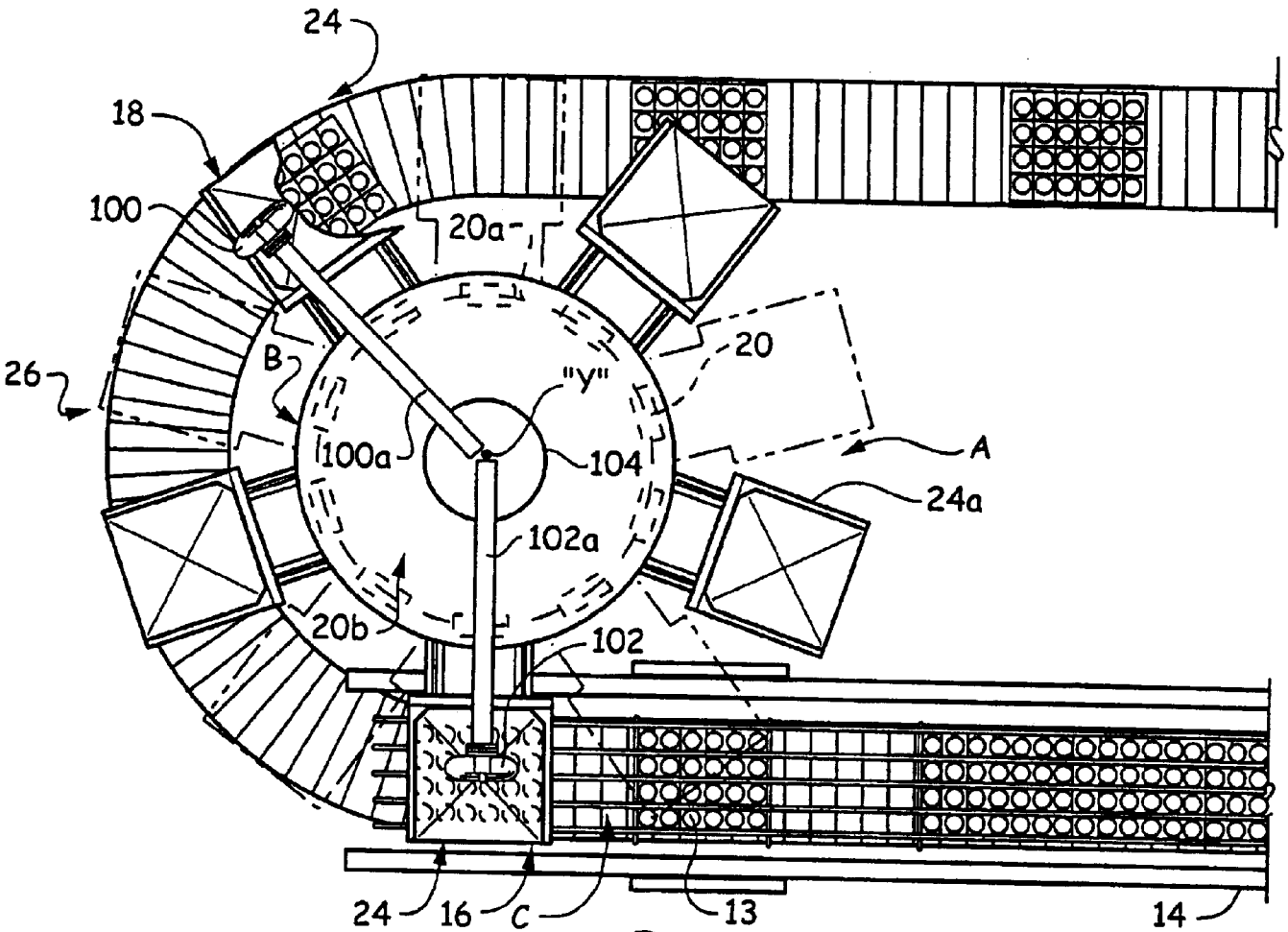
FIG. 2 is a top plan view of the apparatus and method of FIG. 1.

Referring now to the drawings, the invention will be described in more detail. As can best be seen in FIG. 1, apparatus and method for packing articles into cases, or depacking articles from cases, in a simple, continuous circular motion, is illustrated generally as A. The apparatus includes a rotating turret B which rotates about a single vertical axis Y, and a stationary central column 34. A plurality of article transfer arms 20 are carried by the rotating turret, as can best be seen in FIGS. 2 and 3. A plurality of reciprocating grid heads 22 and article pickup heads 24, are carried on the transfer arms. FIGS. 1 and 2 illustrate the embodiment of the invention in the form of a case packing apparatus and method in which articles are packed into cases. In the illustrated embodiment, the pickup and grid heads are slidably carried on the transfer arms and reciprocate in a linear motion for picking up the articles at a pickup station, designated generally as 16. The invention can also be utilized in the form of a case depacking apparatus and method wherein the articles are removed from cases. Presently, and because the inventive aspects are generally the same whether the machine is used for packing or depacking, the invention will be described in relation to the case packing embodiment of the apparatus and method shown in FIGS. 1 and 2.

An article feeder, designated generally as C, is illustrated for conveying articles 13 to pickup station 16. Article feeder C may be a slug feeder having a metering section 12, as disclosed in U.S. Pat. No. 5,797,249 ("the '249 patent"), incorporated herein by reference. Slug metering section 12 receives a continuous flow of articles 13 which are conveyed from a laner section 14. The metering section breaks the articles up into a desired number of articles having a pattern which corresponds to the pattern of the case into which the articles are to be packed. The articles are picked up at pickup station 16 and deposited into empty cases 28 at a release station, designated generally as 18, which constitutes a case packing station in the embodiment of FIGS. 1 and 2. For this purpose, a case indexing conveyor, designated generally as D, is disposed below slug feeder C to provide a continuous flow of indexed cases 28 to release station 18 where the articles are generally deposited in the case. The case conveyor includes lugs 27 for positioning and moving the indexed cases. Advantageously, conveyor D includes an arcuate conveyor section 26 along which the release station and operation occur. The configuration of the illustrated conveyor is that of a U-shape with two parallel legs. The mechanics of a suitable case indexing conveyor arrangement is disclosed in more detail in the incorporated '249 patent. When used as a case depacker, the article feeder constitutes an indexing case conveyor which conveys indexed cases of empty articles for removal.

Figure 3:
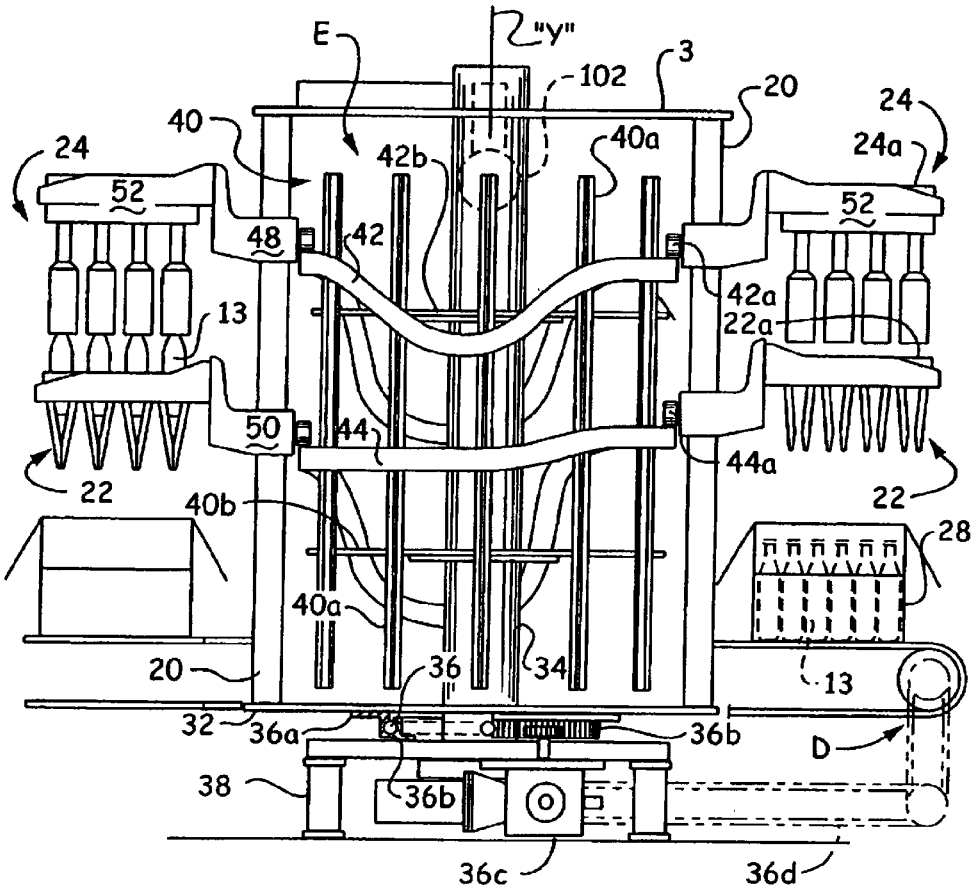
FIG. 3 is a simplified side elevation illustrating apparatus having a turret rotating about a single vertical axis for use in a continuous case packing and depacking apparatus and method according to the invention.

As can best be seen in FIG. 3, turret B includes a top plate 30 and bottom plate 32 between which transfer arms 20 are affixed. Transfer arms 20, in the illustrated form of steel beams, are circumferentially spaced around the plates to generally define a turret cage 20*b* which rotates in circular path 20*a* (FIG. 2). As illustrated, there are ten transfer arms spaced around the turret. The number of arms may vary depending on the appliction. A ring bearing 36 has an outside ring gear 36*a* affixed to bottom plate 32, and an inner bearing race 36*b* affixed to a frame 37 supported on the floor. A gear 36*b* is meshed in driving arrangement with ring gear 36*a* and a drive gear 36*b* of a gear motor 36*c*, also mounted to frame 37. By this means, turret B is rotated clockwise as illustrated. The turret may be also be rotated counter clockwise if the apparatus is designed that way. The gear motor may be utilized to drive case conveyor D through a suitable belt drive arrangement 36*d*, so that the turret and transfer operation are synchronized with the conveying of indexed cases to be packed or depacked.

Within the interior of turret B, as defined by the turret cage of arms 20, is stationary central column or support 34 supported by frame 37. Affixed to stationary support 34 is a cam support drum 40 having a plurality of vertical braces 40*a* affixed to the stationary support by intermediate plates 40*b*. Central support 34 extends through a clearance hole formed in top and bottom turret plates 30, 32. Circular cams 42, 44 encircle and are affixed to braces 40*a* of drum 40. The circular cams form part of a vertical position mechanism E that controls the vertical positions of pickup and grid heads 24, 22. The drum braces, cams, intermediate plates, and central support may be affixed together in any suitable manner, such as conventional bolts, to define a stationary structure about which turret B rotates. Other suitable means of reinforcing and securing the operative construction together may be utilized, such as welding and the like, as will be apparent to a mechanic of average skill in the art.

Figure 4:
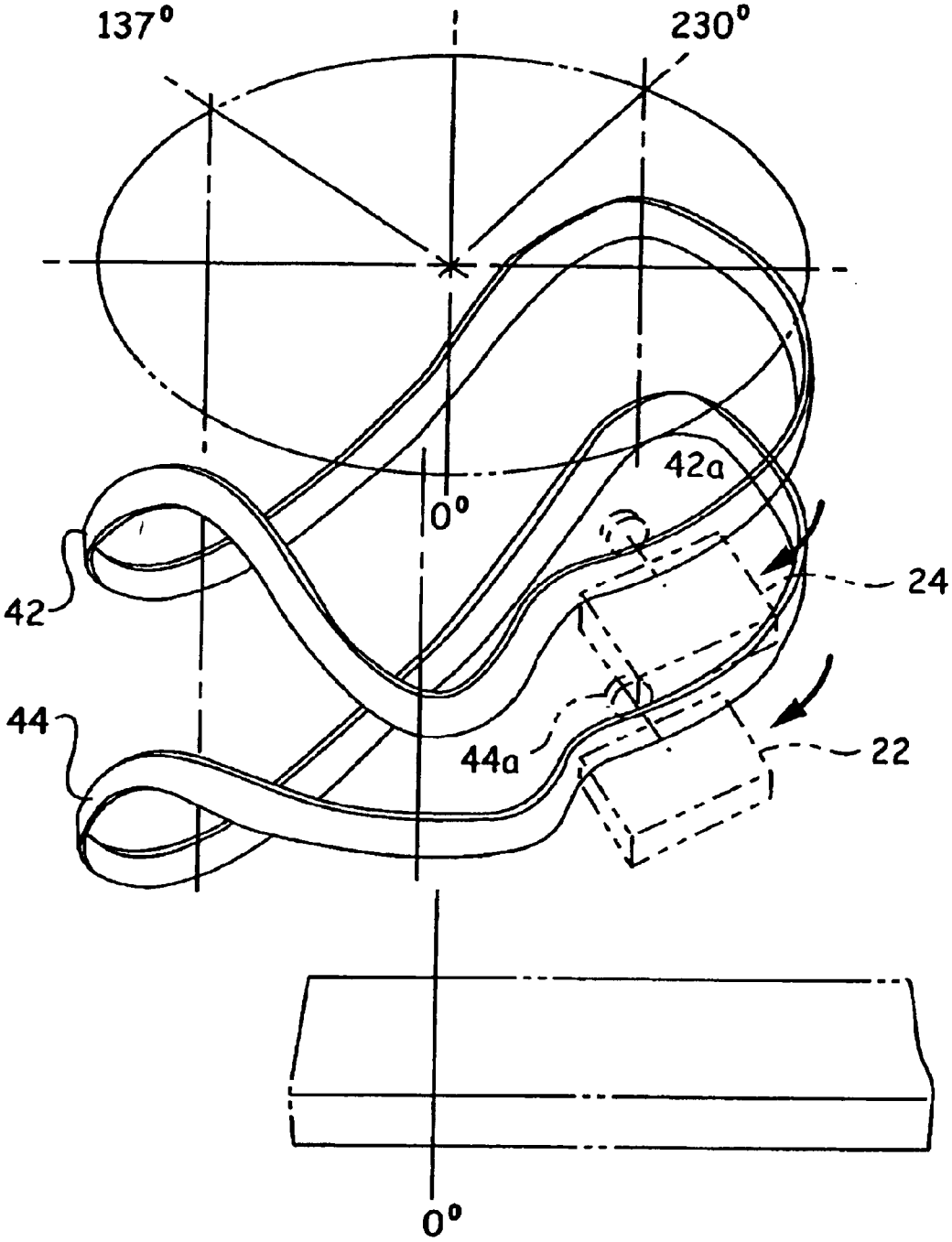
FIG. 4 is a perspective view with parts omitted of a pair of circular cams for controlling the vertical positions of pickup and grid heads carried on a rotating turret according to the present invention.
Figure 5:
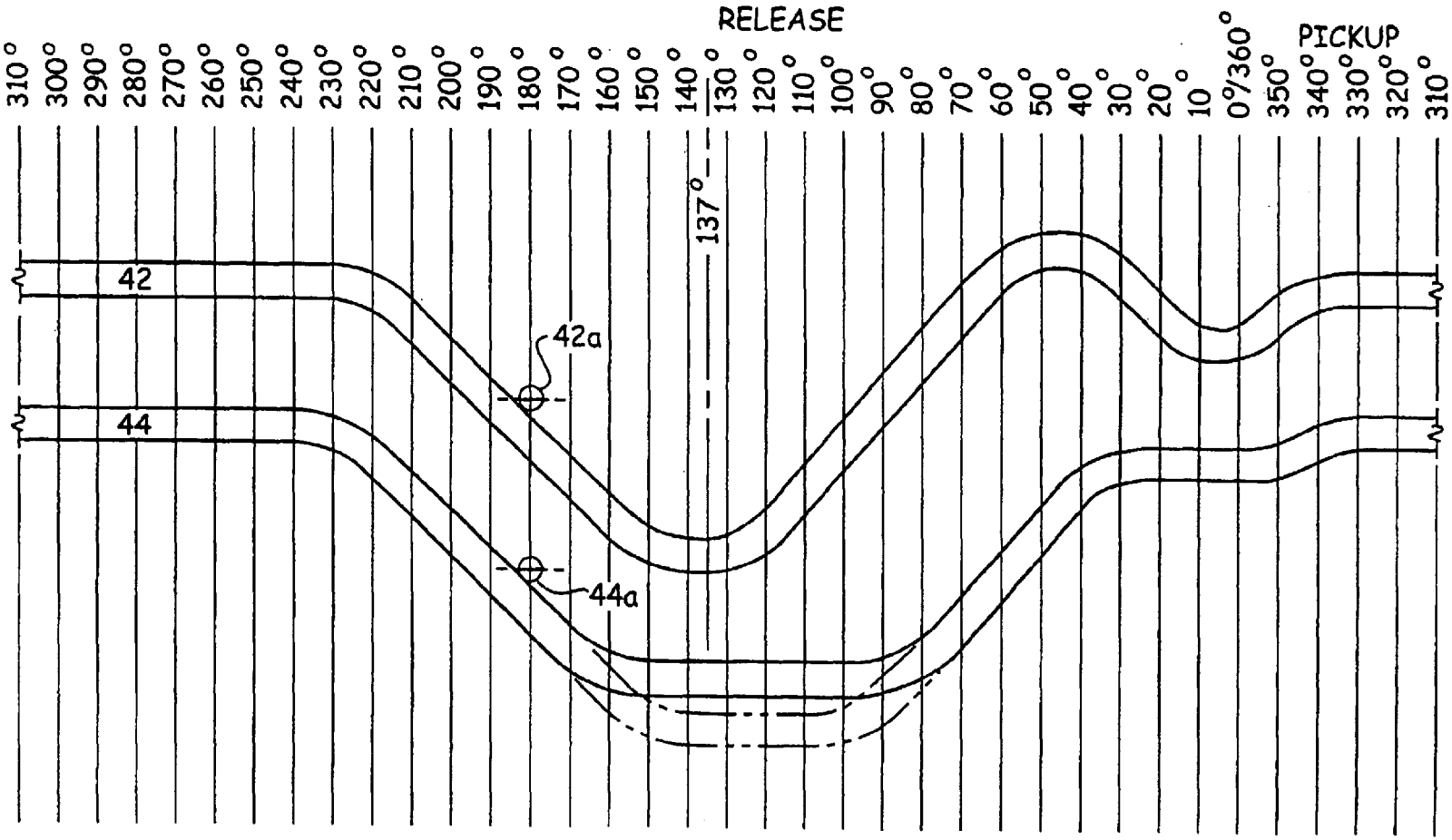
FIG. 5 is a schematic drawing of the cam patterns according to the illustrated embodiment of the invention.
Figure 5A:
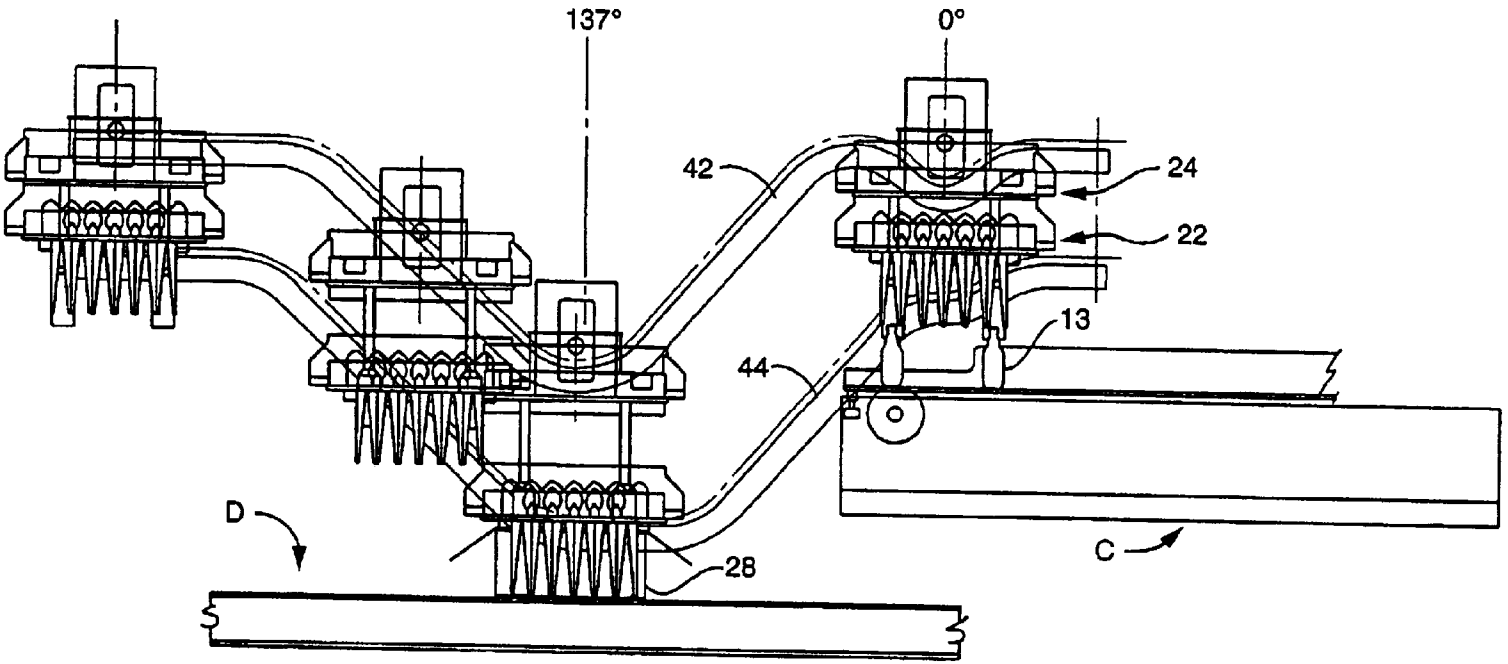
FIG. 5A is a schematic illustration of the sequencing of the pick up operation at an article pickup station according to the invention.

Vertical motion mechanism E preferably includes circular cams 42 and 44 carried 20 by cam mounting drum 40 to control the positions of pickup heads 24 and grid heads 22, as can best be seen in FIGS. 3–6. For this purpose, cam rollers 42*a* and 44*a* are carried respectively by pickup and grid heads 24, 22 which ride on cams 42 and 44, respectively. Pickup heads 24 and grid heads 22 slide on transfer arms 20 by means of guide bearings, designated generally as 48 and 50 respectively. Guide bearing 48 carries a support frame 52 on which pickup head 24 is slidably carried. Likewise, bearing guide 50 carries a support frame 54 which slidably carries grid head 22. Support frame 54 is attached to bearing guide 50 by means of spaced arms 56, and support from 52 may be affixed to bearing guide 48 in the same manner (not shown). Bearing guides 48 and 50 may be constructed in the same manner as bearing blocks 86 and 90 disclosed in the incorporated '249 patent. Cam roller 42*a* is secured to the guide bearing 48 and cam roller 44*a* is secured to guide bearing 50. In this manner, the vertical positions of the pickup head 24 and grid head 22 are controlled as the cam rollers follow circular cams 42 and 44 to provide the desired operational positioning. For examples, FIGS. 4, 5, and 5A illustrate an example of a cam pattern for cams 42, 44 for use with one illustrated embodiment of the invention. In essence, the sequencing and control of the vertical positions of pickup heads 24 and grid heads 22 may be provided like that disclosed in the incorporated '249 patent in regard to the picking up and releasing steps of operation. In the example of FIG. 5, 5A, the picking up (gripper closure) position, is illustrated at zero or 360 degrees, and the release position (gripper open) position is indicated at 137 degrees. After pick up, the heads raise for clearance and then descend for case packing over about 10 to 130 degrees. The heads then raise over about 140 to 230 degrees, and thereafter travel level back to the pickup station over about 230 to 340 degrees.

Figure 8:
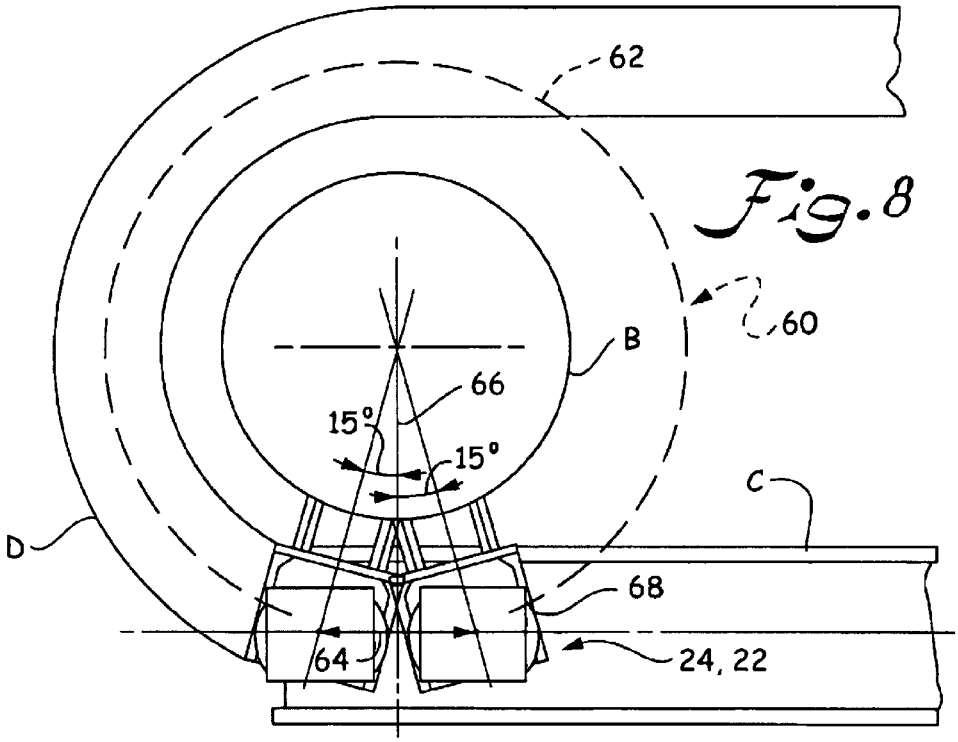
FIG. 8 is a schematic top plan view illustrating a closed cyclic path of pickup heads and grid heads in a case packing embodiment of the invention wherein the circular motion of the heads is converted to a translatory motion along a pickup section for reliable article pickup.

As can best be seen in FIG. 8, pickup heads 24 and grid heads 22 move in a closed cyclic path, designated generally as 60 as they are rotated by turret B. In the case packing embodiment, closed cyclic path 60 includes a circular section 62, shown by dotted lines in FIG. 8, and a linear pickup section 64 shown in a solid line. Along pickup section 64, the heads move over the articles fed in by article feeder C. For this purpose, the circular motion of the pickup and grid heads is converted to a straight-line motion over section 64, along a chordal path illustrated by the double arrow line in FIG. 8, so that the pickup heads may reliably align with the articles and pick up the articles over the pickup section 64. For this purpose, a motion converter is provided for causing pickup heads 24 and grid heads 22 (or pickup heads 24 alone) to move in a straight-line motion, also indicated at 64, over the pickup section. During this time, the pickup heads descend and grip the articles for transfer to the release station. The pickup section 64 is measured over a predetermined arc of rotation of turret B which, in the illustrated embodiment, is an arc of about 30 degrees of turret rotation. The 30 degrees includes 15 degrees either side of a radius line 66 perpendicular to a tangent at the pickup station.

Figure 6:
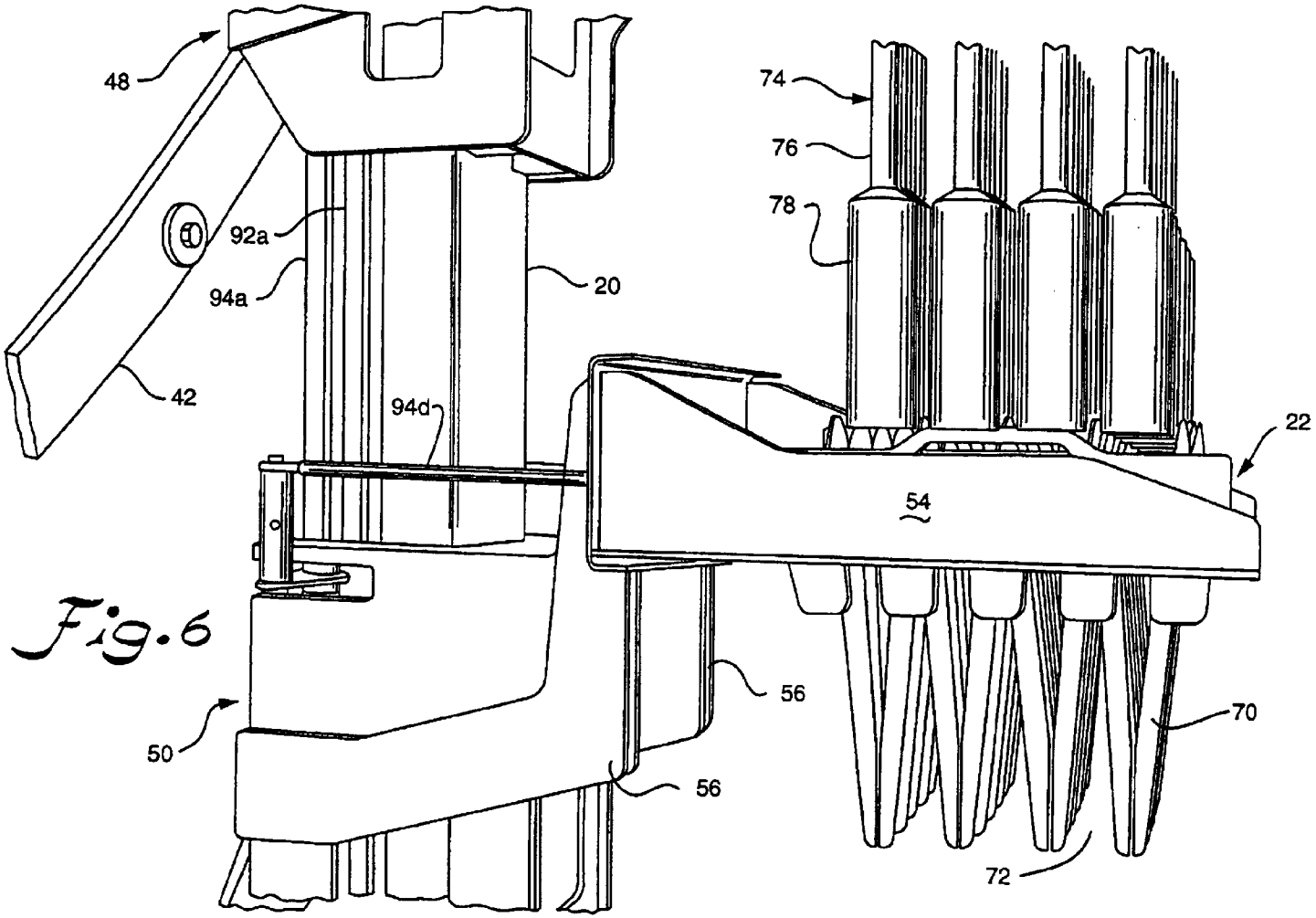
FIG. 6 is a perspective view illustrating parts of a vertical motion mechanism for controlling the vertical positions of pickup and grid heads on a rotating turret according to the invention.
Figure 7:
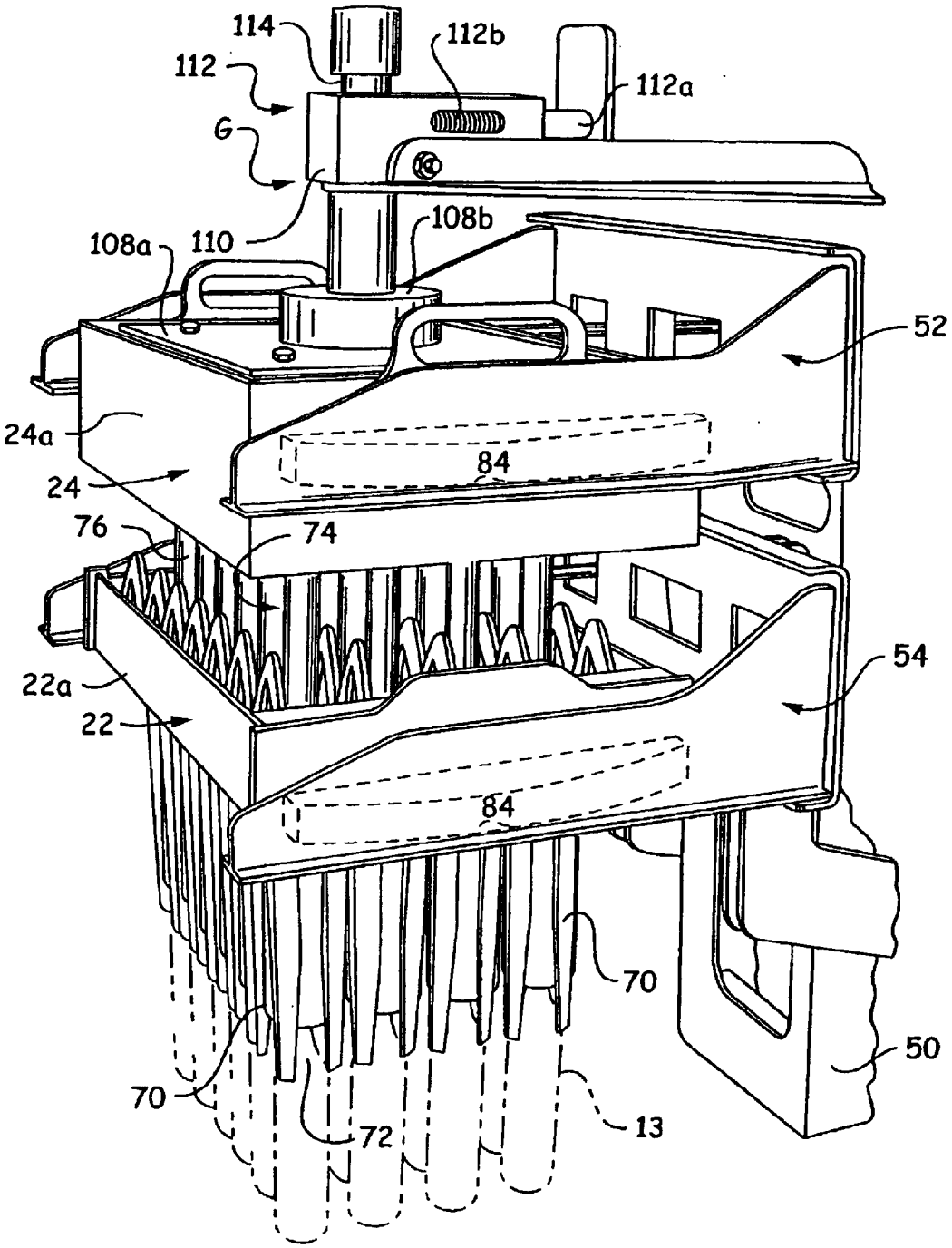
FIG. 7 is a perspective view of the motion mechanism and a pickup head actuator mechanism for controlling the gripping and releasing of articles according to the invention.
Figure 16:
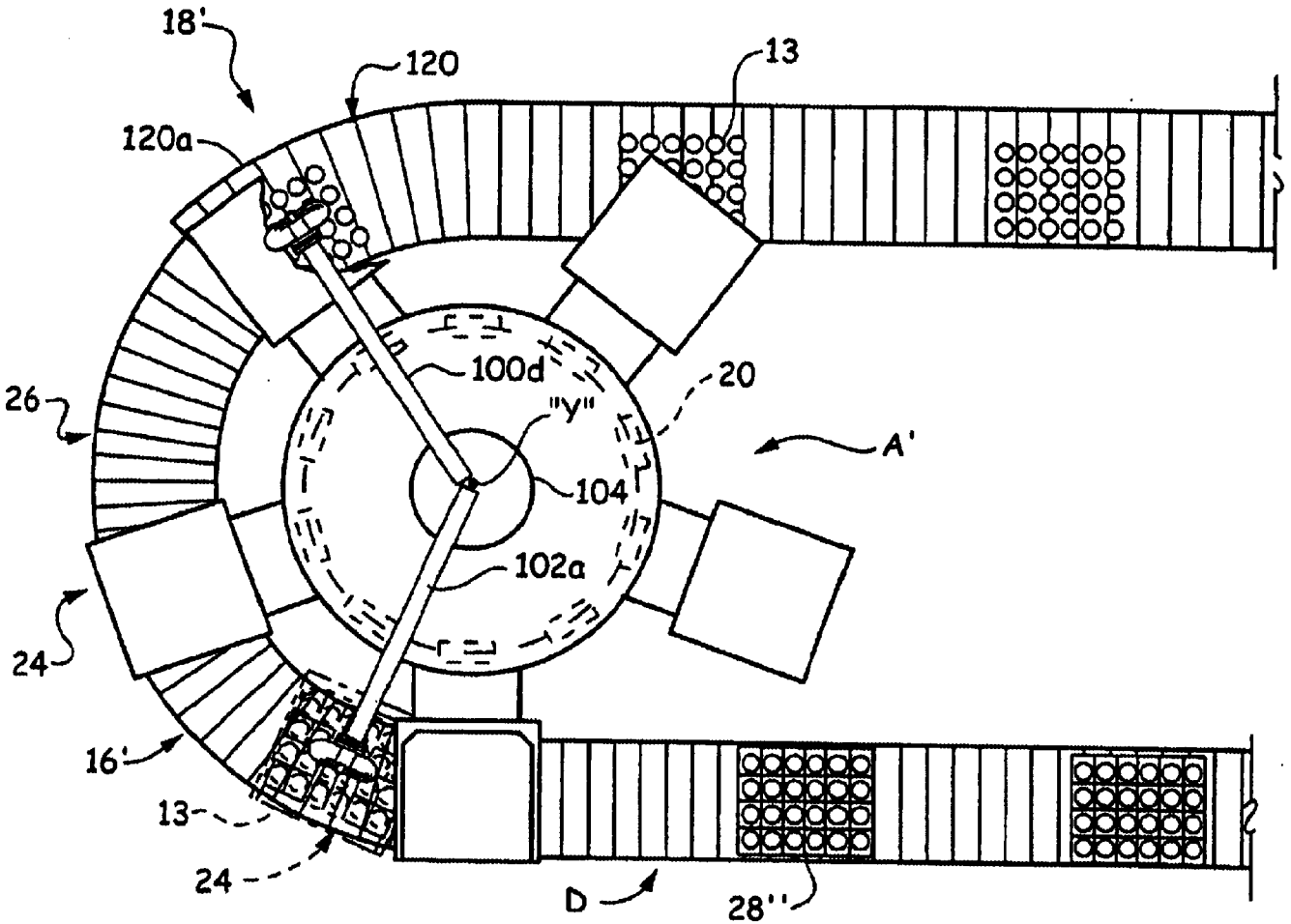
FIG. 16 is a top plan view illustrating a case depacking embodiment of the apparatus and method according to the invention.

Referring now to FIGS. 6 and 7, pickup heads 24 and grid heads 22 will now be described in more detail. While the illustrated embodiment shows the use of the pickup heads with the grid heads, it is to be understood that in some applications only the use of the pickup heads may be needed. However, in the packing of indexed cases, it is desirable, and sometimes necessary, to use grid heads having pivotal fingers 70 to ensure the articles are released into the compartments of the case. In some applications other types of guides or corner guides may be utilized. When used in the depacking embodiment of the invention, the grid heads are not needed because the articles may be released on a bow conveyor which does not require a patterned release (FIG. 16). In addition, the empty articles are already in a pattern in a case at the pickup station and hence the pickup heads do not need to maintain a straight-line motion, particularly when pick up is over an arcuate conveyor congruent with the pickup head path. Grid head 22 includes a plurality of fingers 70 carried by a frame 22*a* to define an array of grid chutes 72 in a pattern corresponding to the pattern of articles 13 to be picked up. The grid chutes are formed by four of the grid fingers. It is preferred that there is a corner grid finger in each corner of the chutes so that the fingers define a generally rectangular chute that corresponds to each compartment of the container. Pickup heads 24 include a plurality of gripper elements, designated generally as 74, carried by a pickup head frame 24*a*. Gripper elements include gripper tubes 76 having grippers, such as pivoting gripper jaws (not shown), disposed within a profiled body 78. The gripper tubes are arranged in the same pattern as grid chutes 72 and the pattern of is articles 13 to be picked up. A pickup head actuator mechanism, designed generally as operates the gripper elements 74 of the pickup head to grip and release articles 13 at the pickup and release stations respectively. Grid fingers 70 are opened and closed by the profiled body 78 gripper elements 74 as the body moves through the fingers. For example, as pickup head 24 descends to pick up the articles, the profile bodies spread the fingers apart to open the grid chutes so that the gripper elements may grip the necks of the articles. Afterwards, the pickup heads move vertically relative to the grid heads in such a manner that the articles are pulled through the grid chutes in an open position. The construction of the pickup heads, grid heads and gripper elements, and their operation, is described in more detail in the incorporated '249 patent.

Figure 9:
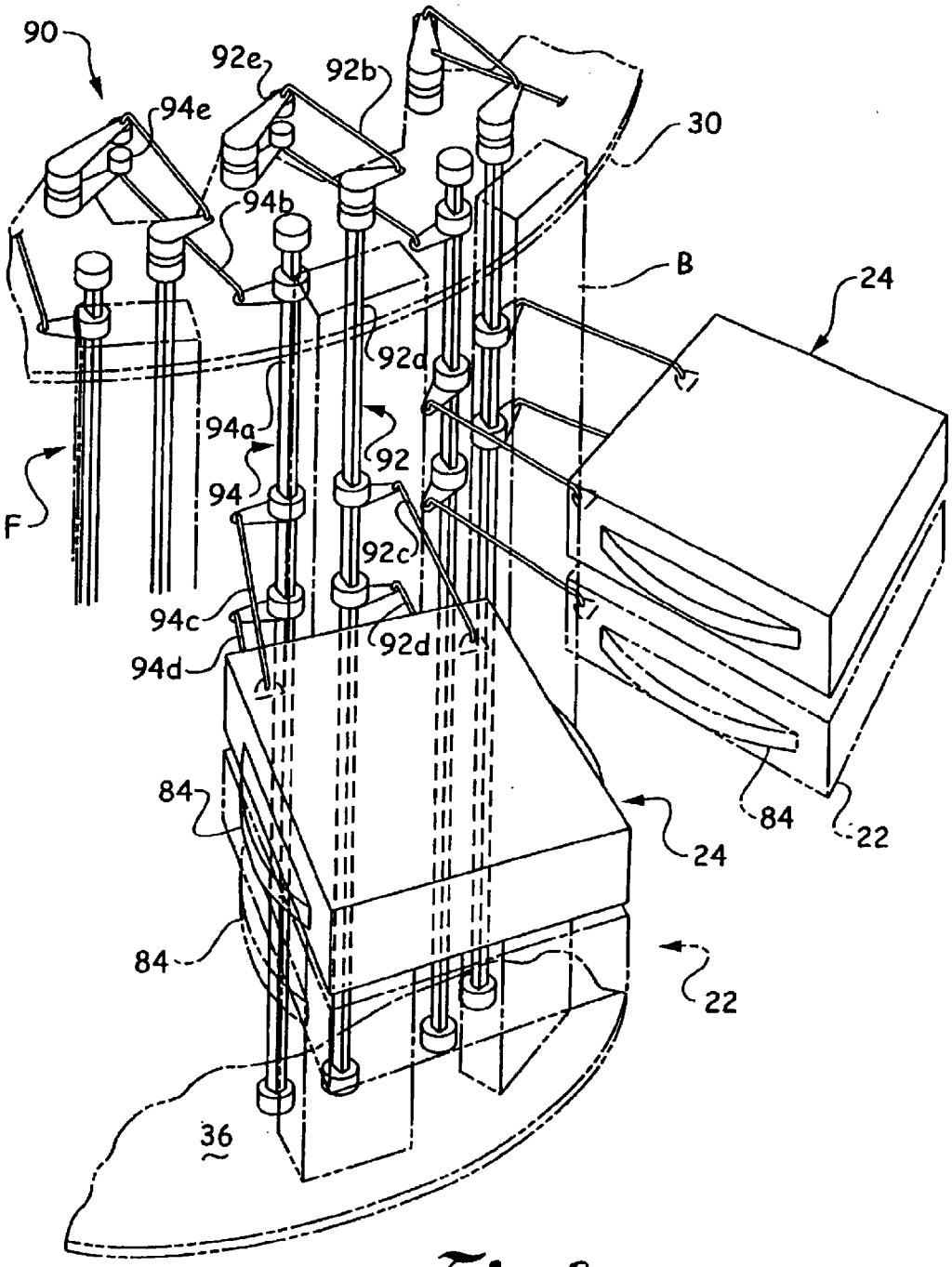
FIG. 9 is a perspective view illustrating a motion converter for the pickup and grid heads which controls the motion of the heads over the pickup section whereby a straight-line motion of the heads is produced.
Figure 10:
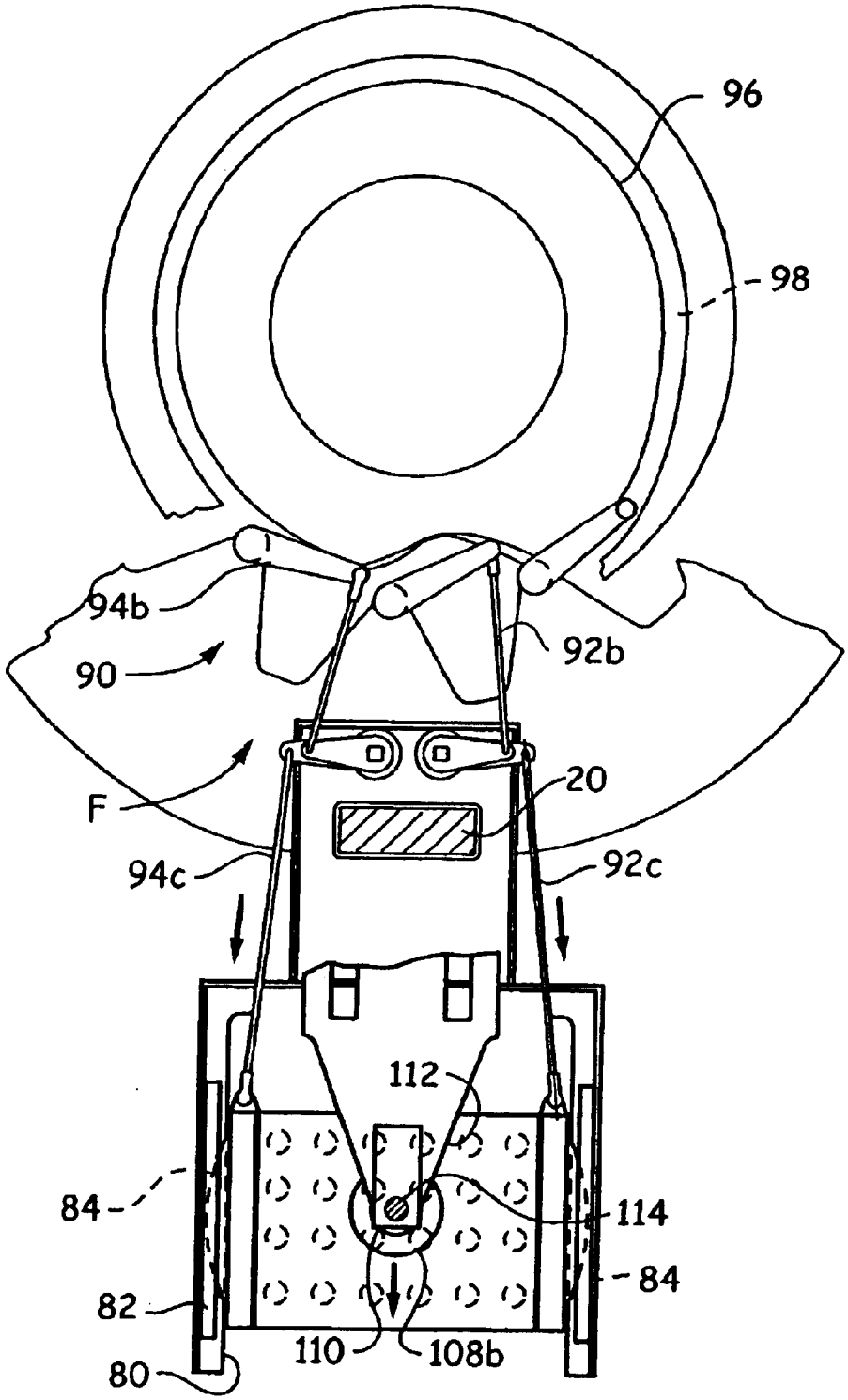
FIG. 10 is a top plan view illustrating the motion converter in a first position at the center point of the pickup section.
Figure 11A:
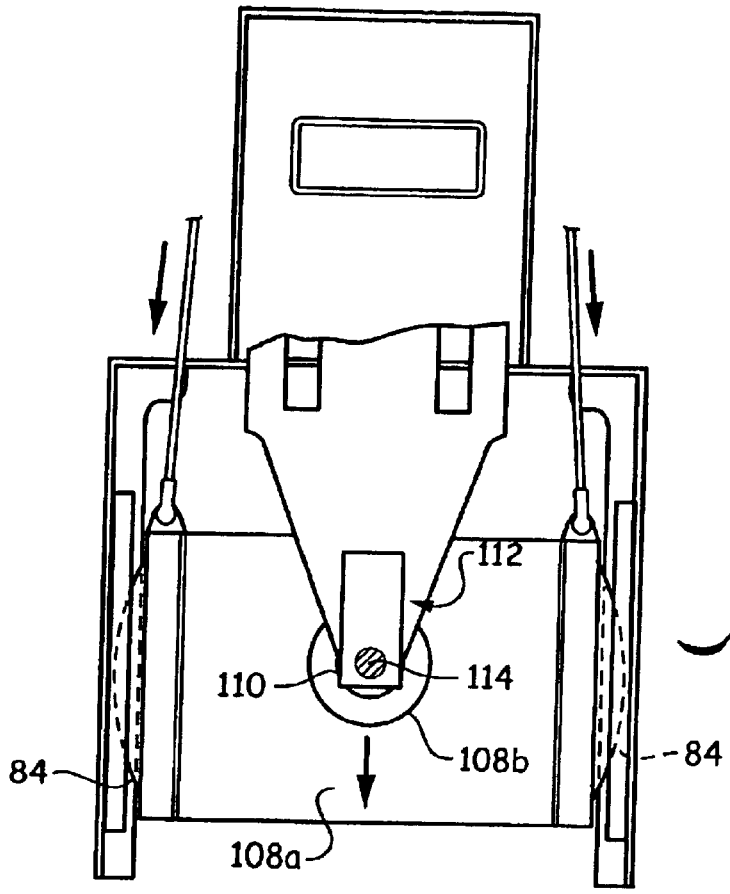
FIGS. 11A and 11B illustrate the combination swivel and translatory motion of the pickup and grid heads over the pickup section to maintain a straight-line motion in the case packing embodiment of the invention.
Figure 11B:
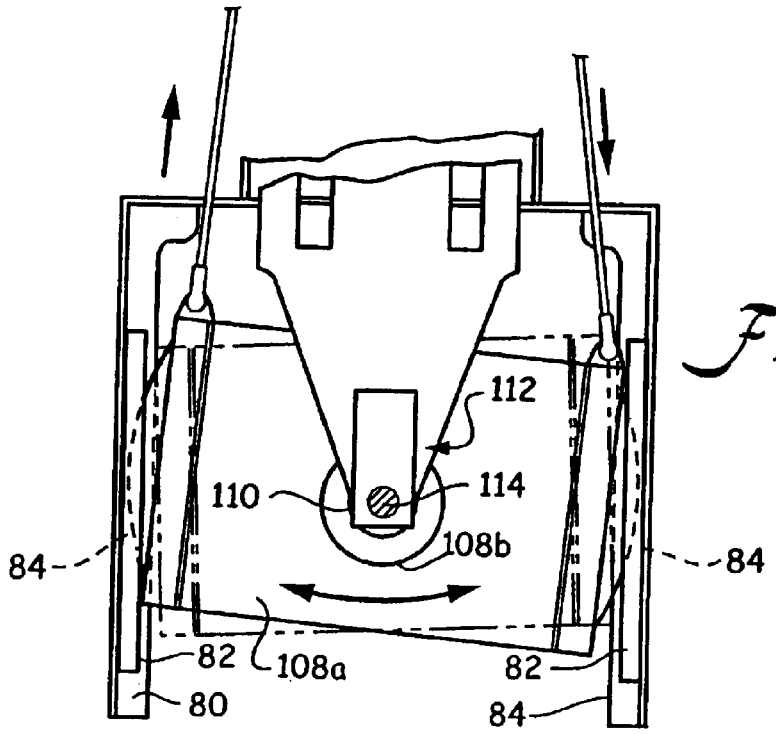

Motion converter F, as can best be seen in FIGS. 9 through 11, will now be described in more detail. First, it is noted that pickup head frame 24*a* is slidably carried in a horizontal frame on pickup head support frame 52 (FIG. 7) having a swivel axis 68. Grid head frame 22*a* is likewise slidably supported on grid head support frame 54. Each support frame 52, 54 includes a bottom ledge 80 and an upper ledge 82 between which a curved bearing member 84 of the head frame is sandwiched on both sides of the frame (FIG. 10). Preferably curved bearing 84 is constructed of a suitable bearing material such as a high molecular weight plastic. By this means, the pickup and grid heads are allowed to slide in a combined swivel and translatory motion within their respective support frames. Thus, in operation, the pickup heads (and grid heads) rotate about a first turret axis Y as they are carried by turret B; and about a second swivel axis 68 along straight-line pickup section 64 (FIG. 8). Motion converter F further includes a plurality of connector mechanisms, designated generally as 90, connected between the rotating turret and an associated set of pickup and grid heads to control movement of the pickup and grid heads so they move in a straight-line motion along pickup section 64. As can best be seen in FIG. 9, connector mechanism 90 includes a first linkage arrangement 92 connected to one side of the pickup head and grid head; and a second linkage arrangement 94 connected to an opposing side of the pickup head and grid head. By this means, the heads are moved in unison. The linkage arrangements include rotary-motion transfer cam shafts 92*a*, 94*a* which are vertically between top and bottom turret plates 30 and 32. Upper arm links 92*b* and 94*b* are received about upper ends of the cam shafts and are secured thereto against rotation. In this manner, actuation of upper arm links 92*b*, 94*b* causes rotation of the cam shafts. First and second lower arm links 92*c*, 94*c*, and 92*d*, 94*d* are slidably carried on cam shaft 92 and 94, respectively. First lower arm links 92*c*, 94*c* are secured to opposing sides of pickup heads 24 and second lower arm links 92*d*, 94*d* are connected to grid heads 22. Cam followers 92*e* and 94*e* carried by the upper arm links 92*b*, 94*b* follow a cam plate 96 which is affixed to the top of stationary column 34 (FIG. 10). The cam followers ride in a cam groove 98 and follow a cam plate 96 to actuate the first and second lower arm links to move the pickup heads and grid heads in a combination swivel and translatory motion to maintain the pickup and grid heads in a straight-line motion over the pickup section 64 for reliable pick up of articles 13. Cam plate 96 may be stationarily mounted on central support 34. This range of motion of the pickup and grid heads can best be seen in FIGS. 8, 10, and 11. Basically, the heads are maintained in a straight-line motion over a linear distance that corresponds to a predetermined arc of about 30 degrees of turret rotation. Other means of converting circular motion of the pickup and/or grid heads may also be used other than illustrated mechanism F. For example, use of position sensors and control through an electronic gear motor may be had, or hydraulic control systems, as well as other mechanical arrangements.

Referring now to FIGS. 12 through 15, pickup head actuator mechanism G will now be described in more detail. First, it is noted, by referring to FIG. 2, that the actuator mechanism includes a first engagement member 100 disposed at release station 18 where it is desired to release the articles, for example into empty cases 28. A second engagement member 102 may be disposed at pickup station 16 where it is desired to pick up the articles. The engagement members are fixed in their relationship by means of support bars 102*a* and 100*a* affixed to a center hub 104 atop column 34. Hub 104 and engagement members 100, 102 are stationary but may be adjusted to desired relative positions before being fixed. In addition, the engagement members may be rotated depending on whether the invention is being used in the case packing or depacking mode (FIG. 16). In the illustrated case packing embodiment, the bars are angularly disposed about 135 degrees, which is about the minimum arc needed to pick up articles and then descend to release them into a case 28. However, it is contemplated that angles in a range of 135 to 180 may be utilized. If need be, the outfeed conveyor leg may be made to wrap more around the turret, if larger angles are needed to provide for a larger arcuate conveyor section, or to save more floor space.

Figure 12:
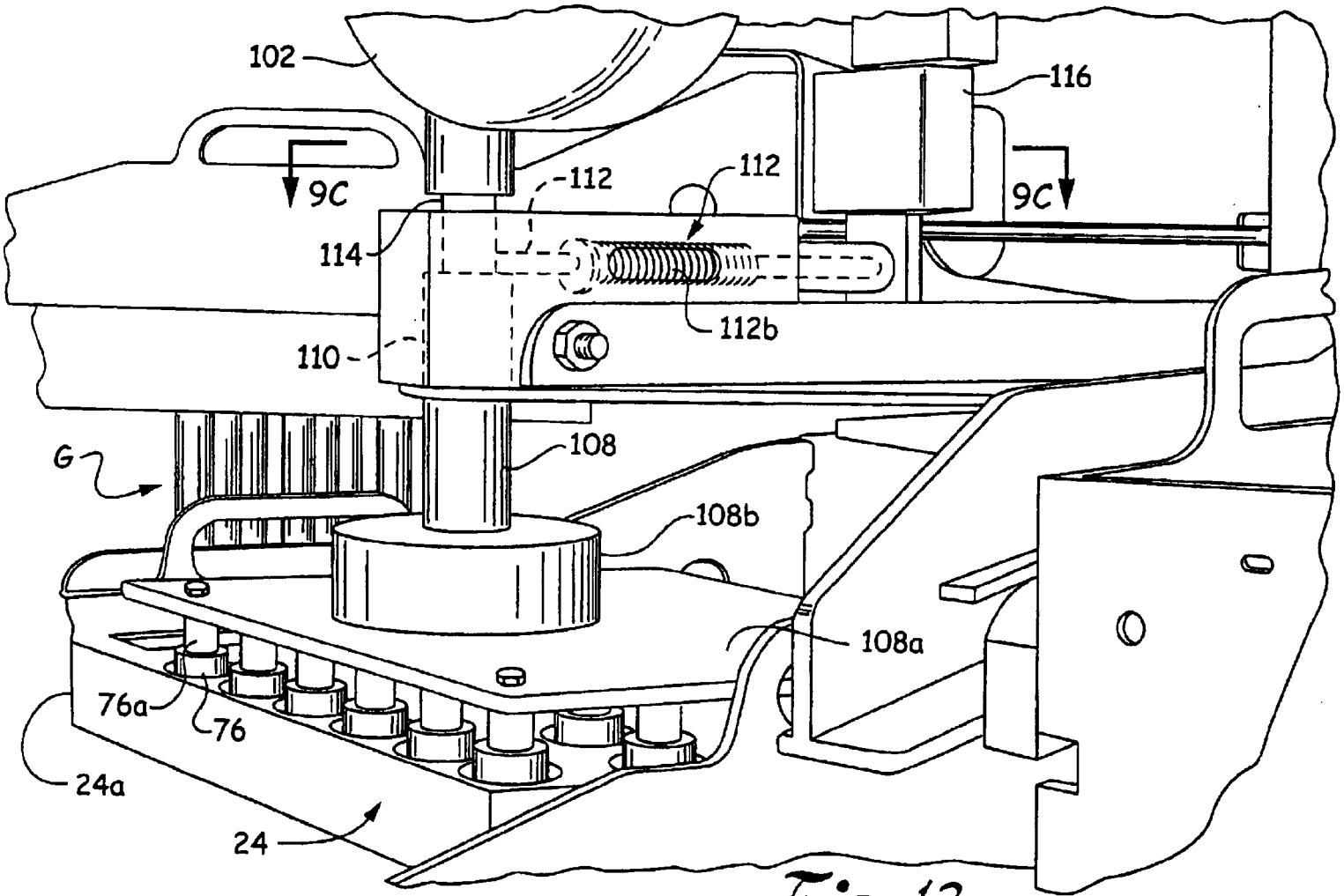
FIG. 12 is a perspective view of the pickup head actuating mechanism for controlling the gripping and releasing of articles by the pickup head according to the invention.

Referring now to FIGS. 12 through 15, it can be seen that engagement member 102 is suspended by means of bracket 102*b* to support arm 102*a*. An unlatching device 106 is likewise carried by bracket 102*b*, whose operation will be described hereinafter. An actuator operator 108 for operating gripper elements 74 is slidably carried in a block 110. Operator 108 bears against an actuator plate 108*a* by means of a hub 108*b*. Hub 108*b* and plate 108*a* slide relative to each other during articulation of the pickup heads to maintain a straight-line motion, as will be explained later. Actuator plate 108*a* bears against reciprocating gripper actuators 76*a* within gripper tubes 76. In addition, actuator plate 108*a* is affixed to the four corner gripper tube actuators by means of bolts (FIG. 12). Gripper actuators 76*a* are normally biased upwards wherein the gripper elements are closed to grip the articles. When biased upwards, gripper actuators 76*a* also bias actuator plate 108*a* and actuator operator 108 upwards. However, when struck by engagement member 100, actuator operator 108 is moved downward causing actuator plate 108*a* to move downward which moves gripper actuators 76*a* downward to release the gripper jaws and articles. There is an optional latching assembly, designated generally as 112, for latching the gripper jaws in their open position to ensure reliability. The latching assembly includes a spring loaded plunger 112*a* also slidably carried in block 110 which is biased toward operator 108. There is a circumferential groove 114 formed in operator 108*a* in which latching plunger 112*a* is received when operator 108 is moved down by engagement member 100 at release station 18 to latch gripper elements 74 in an open position wherein the grippers are maintained spread apart after article release. In the illustrated embodiment, engagement members 100, 102 are in the form of a rubber tire so that the striking of operator 108 is cushioned.

In operation, at release station 18 when operator 108 is struck by engagement member 100, the articles are released from gripper elements 74 into cases 28. At that time, plunger 112*a* latches the fingers open since its insertion in groove 114 prevents upward movement of operator 108 and hence gripper actuators 76*a*. The gripper elements or jaws are not allowed to close. This is an advantage because the article grippers will now be spread apart and open at the pickup station for being received over the articles. However, in order for the gripper elements to close upon the articles at the pickup station, it is necessary that the latch 112*a* be retracted from gripper 114 so that operator 108 may move upwards under the spring force of gripper actuator 76*a* at the pickup station. For this purpose, unlatching device 106 includes a cam block 116 carried at the pickup station, as can best be seen in FIGS. 15*a* through 15*c*. Cam block 116 has an apex 116*a*.

Figure 15B:
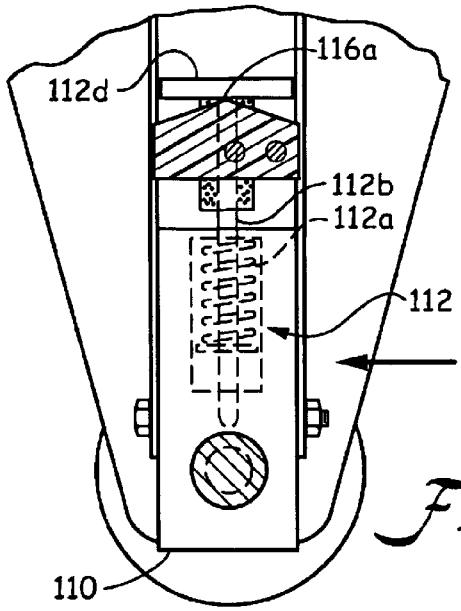
FIG. 15B is a top plan view of the pickup head actuating mechanism at the article pick up position wherein a latching mechanism has been withdrawn to allow the gripping jaws to close on the article.
Figure 15C:
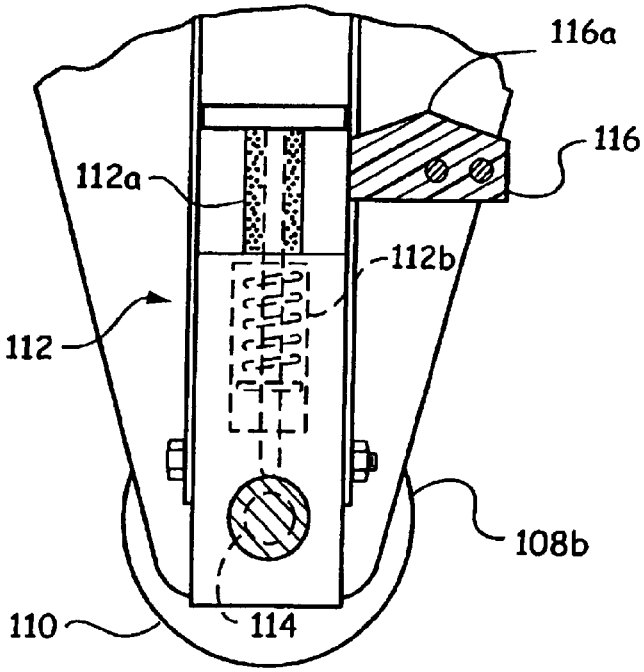
FIG. 15C is a top plan view with parts cut away and omitted illustrating the pickup head actuating mechanism in which the mechanism has passed the pickup station and the mechanism is in a position which allows the gripping fingers to remain closed.
Figure 15A:
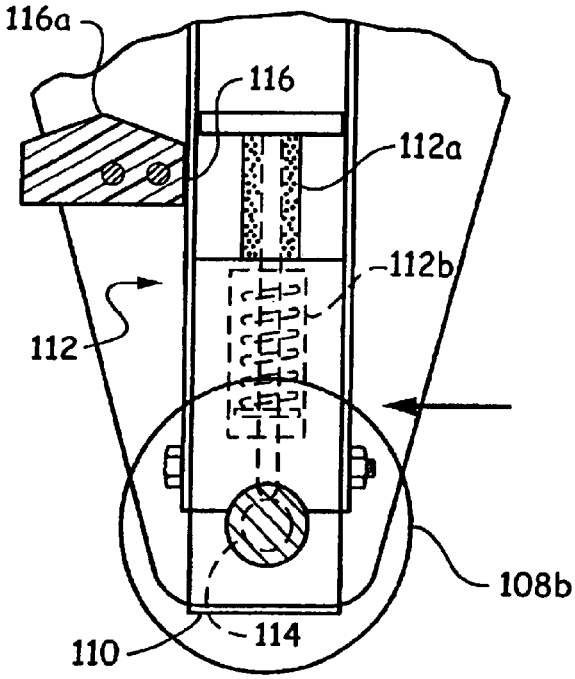
FIG. 15A is a top plan view with parts omitted and cut away illustrating the pickup head actuating mechanism of the present invention prior to pick up of the articles.

The sequencing of operation at the pickup station will now be described. In FIG. 15*a*, the article grippers are latched open and the pickup head is approaching cam block 116. At the time the apex 116*a* of the cam block engages unlatching plate 112*d*, second actuator element 102 engages actuator operator 108, pushing it down (FIG. 15B). This relieves the pressure on latch plunger 112*a* so that it is reliably disengaged from groove 114 by the riding up of unlatching plate 112*d* onto apex 116*a*. In FIG. 15C, it can be seen that plunger 112*a* bears against operator 108 below groove 114 because operator 108 has been raised by the upward, spring biased movement of gripper actuators 76*a* which has closed the gripper elements around the articles.

Figure 13:
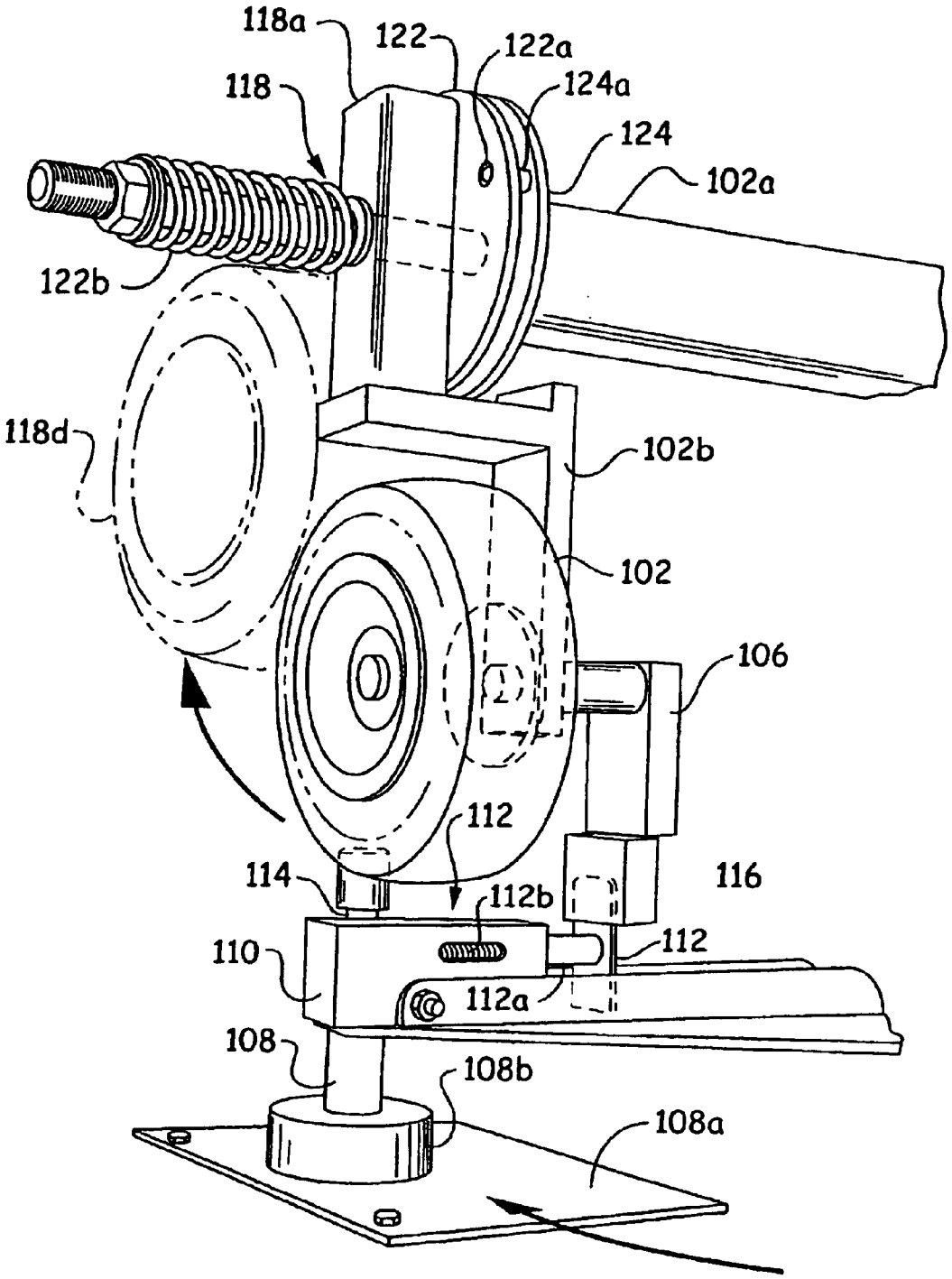
FIG. 13 is a perspective view of the pickup head actuating mechanism and an overload kick out mechanism disposed at the pickup station of a case packing machine according to the invention.
Figure 14:
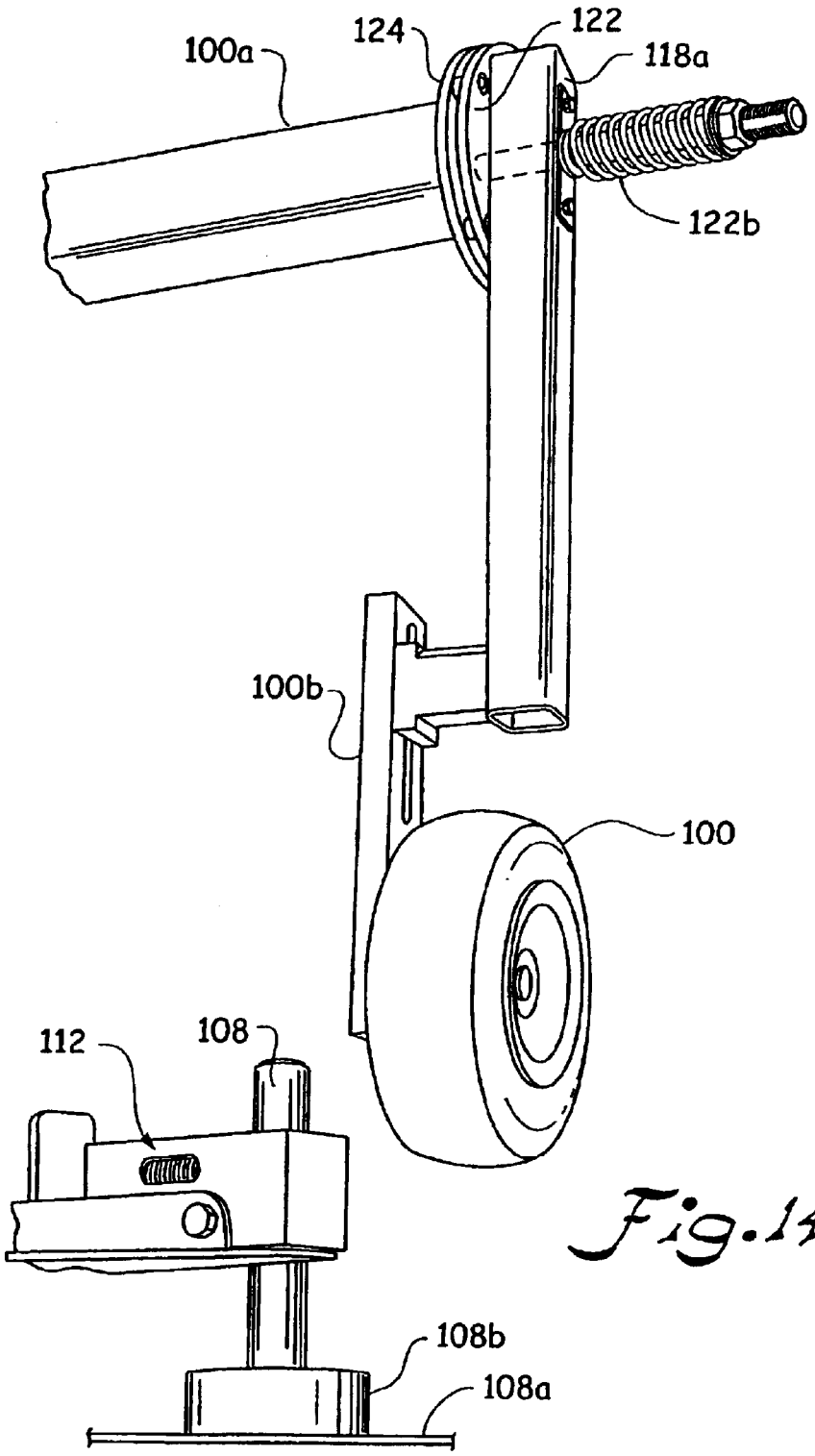
FIG. 14 is a perspective view of the parts of a pickup head actuating mechanism and overload kick out mechanism disposed at a release station of the case packing embodiment according to the invention.

As can best be seen in FIG. 13, there is also a overload kick out mechanism 118 illustrated which automatically kicks up out of the way if wheel 100 or 102 is accidentally struck sideways by an operator 108. To prevent a malfunction at the pickup station, the wheel is allowed to kick up to prevent damage in a jam or overload. If struck sideways by an out of position operator, the overload kick out mechanism allows a wheel to pivot to dotted line position 118*d*. For this purpose, there is a support 118*a* affixed to bracket 102*b* which carries engagement member 102. A plate 122 is affixed to support 118*a*. A spring and shaft assembly 122*b* passes through the plate 122 and is secured to a plate 124 to urge plate 124 against plate 122. A ball/detent assembly 122*a*, 124*a* locks plate 122 and 124 together in the position shown. However, should engagement member 102 be struck sufficiently from the side by operator 108 or other structure, plate 122 and support 118*a* are released to pivot wheel 102 out of the way.

Referring now to FIG. 16, the operation of the apparatus and method in the embodiment of a case depacking machine will now be described. In this case it can be seen that first and second engagement members 100 and 102 are rotated approximately 25 to 35 degrees from their positions when used in the case packing embodiment. Empty articles 13 are picked up from empty cases 28' at a pickup station designated generally as 16' and released over a bow conveyor 120 at a release station generally indicated at 18'. For this purpose arms 100*a* and 102*a* are rotated slightly from the case packing embodiment. The arms are approximately 135 degrees apart, although they may range anywhere from 130 to 180 degrees apart. It is noted that both stations occur over the arcuate conveyor sections at 26 and 120*a*. The cases containing the empty articles are conveyed on case indexing conveyor D essentially as shown in the case packing embodiment. It is also possible to wrap bow conveyor 20 around turret B, for example even 180 degrees, and then turn parallel to case conveyor D and the incoming cases 28', as illustrated at 120*b*, so that floor space is further conserved.

As noted previously, there may not be a no need to use grid heads 22 when depacking. Pickup heads 24 are carried in the same manner as described previously in the case packing embodiment, and descend into the cases to pick up the articles 13. Since the articles are already arranged in a pattern and aligned with the pickup heads over their congruent arcuate paths, there is no need to move the pickup heads in a straight line. By conveying the cases on an indexing conveyor having an arcuate section 26, it is possible to follow the cases by moving the pickup heads in a congruent path with the cases while the pickup heads descend to grip the articles. At release station 18', it is also not necessary that the articles be in an exact pattern when released over an arcuate section of bow conveyor 120. Thus, engagement members 100, 102 act in the same manner as described previously. For example, engagement member 100 strikes operator 108 to release the gripper elements 74 and the articles 13 therefrom. Upon the opening of the gripper jaws of the gripper element 74, the gripper jaws are latched in their open position as described previously. As the pickup head travels back around to pick up station 16', the unlatching device and second engagement member 102 work in combination to depress operator 108, relieving pressure on plunger 112*a*, so that the fingers are unlatched and allowed to close to pick up the articles in the empty cases. It can be seen that a continuous circular motion case depacking machine can be provided according to the present invention wherein at least one of the pickup and release stations occurs over an arcuate conveyor section. While it is possible to use a circular to straight-line motion conversion to pick the articles up along a straight run, it is not necessary, and the arcuate conveyor and rotating turret allow for a more compact arrangement.

While a conventional type conveyor is disclosed for conveying the indexed cases, it is also contemplated that a rotating case plate can be utilized for circulating the cases in synchronization with the turret. The plate may be circular and affixed directly to a lower portion of the turret to provide the arcuate conveyor section defined herein. The plate may include circumferentially spaced positioning lugs 27 corresponding to a desired placement of the cases in alignment with a corresponding pickup head. The cases can be wiped on the circular plate from an infeed conveyor and wiped off the circular plated onto a conventional ouffeed conveyor, thus eliminating the need for an expensive, flexible, or table top conveyor around the rotating turret.

Thus, it can be seen that a highly advantageous apparatus and method for a continuous case packing and depacking machine can be had according to the present invention wherein a small foot print, turret may be rotated continuously to pick up and release articles at a high speed while requiring only a small floor area. The transfer of articles occurs at high speeds yet the motion is balanced and smooth since it is basically circular. The dynamic forces produced by orbital machines having straight runs and radial ends is avoided. By converting the motion of the pickup heads from circular to translational when the articles are picked up, reliable pick up of the scrambled articles is provided for reliable insertion into a partitioned case. The case packing may occur over an arcuate section of the conveyor immediately after pick up by using congruent case and pickup head paths at increased speeds.

While a preferred embodiment of the invention has been described using specific terms, such description is for illustrative purposes only, and it is to be understood that changes and variations may be made without departing from the spirit or scope of the following claims.

What is claimed is:

1. Apparatus for continuously transferring articles from a pickup station to a release station, said apparatus which includes a plurality of pickup heads for picking up the articles at said pickup station and releasing the articles at said release station, said pickup station and said release station located at different sections of a radial path, a vertical motion mechanism for moving said pickup heads to operative positions relative to the articles at said pickup and release stations, and an article conveyor for continuously conveying articles to the pickup station, said apparatus further comprising:

a rotating turret, which continuously rotates about a single vertical turret axis and carries a plurality of article transfer arms about said axis;

a plurality of reciprocating pickup heads arranged in a circle on said turret, and said pickup heads being carried by said transfer arms for picking up the articles at said pickup station and releasing the articles at said release station;

said turret continuously rotating said transfer arms about said axis to continuously move said pickup heads and articles from said pickup station to said release station along said radial path; and a motion converter associated with said turret and operatively connected to said pickup heads, said motion converter causing said pickup heads to move generally in a straight-line path through the pickup station for picking up the articles at the pickup station; and said motion converter including connector mechanisms partially outside said turret connected between said rotating turret and said pickup heads and operative along said straight-line path for swiveling said pickup heads about a swivel axis to effect said straight-line path through the pickup station.

2. The apparatus of claim 1 wherein said motion converter moves said pickup heads a distance which corresponds to a predetermined arc of said turret rotation.

3. The apparatus of claim 2 wherein said predetermined arc is generally about 30 degrees of turret rotation.

4. The apparatus of claim 1 wherein said motion converter further includes:

support frames carried by said transfer arms for slidably carrying said pickup heads so that said pickup heads may swivel about said swivel axis relative to said support frames as said frames and pickup heads rotate about said turret axis;

to impart swivel and translatory motions to said pickup heads on said frames.

5. The apparatus of claim 4 wherein said connector mechanisms include vertical cam shafts, linkage arrangements connected between said vertical cam shafts and said pickup heads for imparting said motions to said pickup heads; and said linkage arrangements being slidably carried by said cam shafts to slide up and down as said pickup heads reciprocate vertically during pick up and release of the articles while carried by said turret.

6. The apparatus of claim 5 including cam followers connected to said linkage arrangements, and at least one cam mounted to a stationary support disposed inwardly of said turret, and said cam followers engage said cam to impart said motions to said pickup heads.

7. The apparatus of claim 6 wherein said release station is a case packing station where articles are deposited into cases, and including a case conveyor for conveying cases to said release station for receiving the released articles in synchronization with said rotating turret; wherein said pickup heads and case conveyor have a generally congruent arcuate path along which said pickup heads and cases move at said release station.

8. The apparatus of claim 5 wherein said turret includes a plurality of vertical transfer arms, said pickup heads being slidably carried on said vertical transfer arms, said vertical motion mechanism controlling the vertical positions of the pickup heads on said transfer arms as they rotate with said turret; and wherein said linkage arrangements connected between said vertical cam shafts and said pickup heads slide on said vertical cam shafts as said pickup heads reciprocate vertically on said transfer arms during pick up of the articles.

9. The apparatus of claim 8 including reciprocating grid heads disposed below said pickup heads having a plurality of guides arranged in a pattern for guiding the articles into the cases, said grid heads carried for vertical reciprocation in alignment with said pickup heads, and said connector mechanisms of said motion converter being connected to said grid heads for swiveling said grid heads and pickup heads together to move said grid and pickup heads in said straight-line path through said pickup station.

10. The apparatus of claim 9 wherein said vertical motion mechanism includes first and second circular cam surrounding said stationary support, and cam rollers associated with said pickup and grid heads which follow said first and second cams as said turret rotates so that the vertical positions of said pickup and grid heads are controlled in synchronization.

11. The apparatus of claim 1 including reciprocating grid heads disposed below said pickup heads having a plurality of guides arranged in a pattern for guiding the articles into the cases, said grid heads carried for vertical reciprocation in alignment with said pickup heads, and said connector mechanisms of said motion converter being connected to said grid heads for swiveling said grid heads and pickup heads together to move said grid and pickup heads In said straight-line path through said pickup station.

* * * * *